United States Patent [19]

Finn

[11] 4,113,097

[45] Sep. 12, 1978

[54] AMPULE CAPABLE OF BEING AUTOCLAVED

[75] Inventor: James J. Finn, Upper Saddle River, N.J.

[73] Assignee: Diagnostic Isotopes Incorporated, Upper Saddle River, N.J.

[21] Appl. No.: 712,802

[22] Filed: Aug. 9, 1976

[51] Int. Cl.[2] ..... A61J 1/06; B65D 85/54

[52] U.S. Cl. ..... 206/528; 128/272; 138/31; 206/538; 215/6

[58] Field of Search ..... 128/272; 138/26, 30–31, 138/89; 206/0.6, 213.1, 364–365, 528, 538; 220/3, 22.1, 93, 201, 208; 215/6, 247, 271; 21/56

[56] References Cited

U.S. PATENT DOCUMENTS

| | | | |
|---|---|---|---|
| 2,111,985 | 3/1938 | Meyer | 215/6 X |
| 2,339,132 | 1/1944 | Arnot | 138/31 X |
| 2,953,151 | 9/1960 | Snyder | 138/31 X |
| 3,633,627 | 1/1972 | Perrott | 138/31 |
| 3,842,836 | 10/1974 | Ogle | 215/6 X |
| 3,862,042 | 1/1975 | Ayres | 128/272 X |

*Primary Examiner*—Steven E. Lipman
*Attorney, Agent, or Firm*—Pennie & Edmonds

[57] ABSTRACT

An ampule for containing a soluble gas in a solution where the ampule comprises a tubular member having a moveable plunger therein dividing the ampule into an expansion space and a solution containing space whereby a solution may expand and move the plunger into the expansion space when the ampule is autoclaved.

4 Claims, 1 Drawing Figure

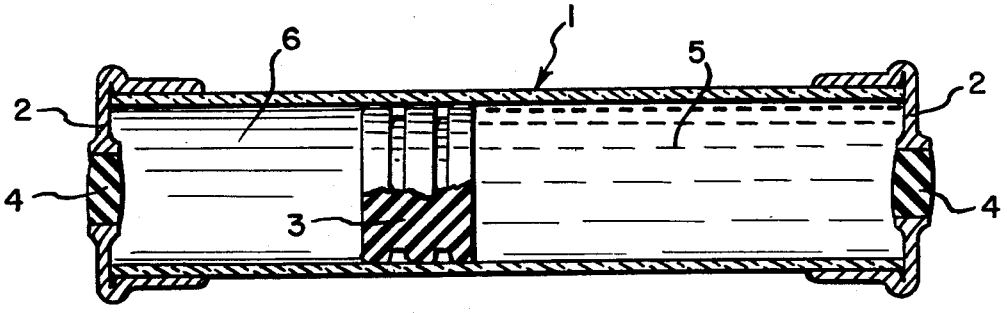
1
2
2
3
4
4
5
6

AMPULE CAPABLE OF BEING AUTOCLAVED

BACKGROUND OF THE INVENTION

It is important in the packaging and storage of many materials utilized in medical diagnosis that an ampule or package containing the material be terminally sterilized as by autoclaving prior to its being opened and dosages removed therefrom. This may present a problem where the ampule contains a material such as a radioactive Xenon gas which is used for example, in diagnosis of cardiac abnormalities, cerebral blood flow studies, pulmonary function studies and muscle blood flow studies. Such gases are usually dissolved in a saline solution in order that they may be administered intravenously into a patient's blood stream. Because such gases as Xenon are not readily soluble in a solution, it is important that any solution containing the gas be entirely enclosed and not open to any air space. This presents a problem in packaging where an ampule must be sterilized by heat since any heat applied to the ampule will necessarily cause the solution containing the soluble gas to expand.

A further problem arising when conventional ampules are used in the packaging of solutions which should be kept from contact with air is that only one dose may be taken from the ampule with the remainder of the solution then thrown away. This can be extremely wasteful and expensive and even dangerous when the solutions comprise a radioactive material such as Xenon. It is therefore an object of my invention to provide for a novel ampule construction which may be subjected to autoclaving to insure complete terminal sterilization of the ampule and to also provide for an ampule construction which may hold a plurality of dosages such that individual dosages may be removed from the ampule without contaminating the remainder of the dosages left in the ampule with air.

GENERAL DESCRIPTION OF THE INVENTION

Broadly I provide for an ampule having a hollow member with a moveable plunger therein which divides the ampule into a solution containing space and an expansion space. The hollow member is preferably in tubular form and has rubber seals located at each end. The solution containing space of the ampule is completely filled with solution so that no air space remains while maintaining the expansion space. Upon heating of the ampule as by autoclaving, expansion of the solution will cause the plunger to move into the expansion space.

A dosage is removed by either inserting a vent needle into a first seal adjacent the expansion space or otherwise removing or rupturing that seal and then inserting a hypodermic needle through a second seal adjacent the solution containing space to allow solution to flow into a syringe. Atmospheric pressure in the expansion space will cause the plunger to move towards the second seal to reduce the volume of the solution containing space by an amount equal to the volume of the dosage removed. In this way, air-free integrity of the solution containing space is maintained with the remainder of the solution left in the space being available for further dosages.

REFERENCE TO THE DRAWING

The drawing illustrates a cross-sectional view of an ampule constructed according to the invention.

DESCRIPTION OF THE PREFERRED EMBODIMENT

Referring to the drawing, there is illustrated an ampule comprising a glass tube 1 having an elastomeric plunger 3 moveable therein. The tube 1 has ends 2 containing rubber seals 4 where the ends comprise metal portions crimped onto the glass tube. The plunger forms along with the tube 1 and the ends 2 a solution containing space 5 and an expansion space 6.

The ampule is filled by first cooling the Xenon gas to an extremely low temperature to liquify it and then mixing it with a saline solution. The plunger is positioned in the tube which previously has had one end containing a seal crimped thereon so as to form an expansion space. The solution containing space of the chamber is then completely filled with the solution containing the dissolved gas and the remaining end portion containing a seal crimped onto the tube. In this manner, the solution containing space will be assured of being air-free while at the same time preserving an expansion space into which the plunger may move.

Upon autoclaving, the solution will be heated and expand causing the plunger 3 to move to the left towards the expansion space 6. After autoclaving and on cooling of the solution, the plunger 3 will move towards the solution containing space 5 under the force of the pressure remaining in space 6.

A dosage is removed by inserting a vent needle through the seal 4 adjacent the expansion space 6 or otherwise breaking or rupturing that end. A hypodermic needle is then inserted into the opposite seal adjacent the solution containing space 5. Removal of a dosage will cause the plunger 3 to move to the right under the force of atmospheric pressure in space 6 to reduce the volume of the space 5 by an amount equal to the volume of the dosage removed. The solution remaining in space 5 will continue to take up the complete space so that the integrity against any air spaces being formed is maintained.

In some instances it may be advisable to pressurize the expansion space above atmospheric. In this event, it would not be necessary to vent or break the seal adjacent the expansion space on removal of dosages since the pressure in the expansion space would be sufficient to move the plunger.

An ampule as constructed as described above will provide a package which may be terminally sterilized and at the same time maintain the air-free integrity of a solution contained in the ampule. Further the ampule provides a package by which individual dosages in solution form may be removed while maintaining the air-free integrity of the remaining solution in the ampule.

I claim:

1. An ampule which comprises, in combination, a tubular body of uniform diameter having end members each containing a rubber seal, a plunger of unitary construction being impervious to fluids and disposed moveably within the tubular body, said plunger defining a first compartment containing a dosage solution and a second compartment containing a gas within an expansion space, whereby upon autoclaving the ampule said plunger moves toward the expansion space to accommodate the expansion of the dosage solution.

2. An ampule according to claim 1 wherein said gas within the expansion space is at atmospheric pressure prior to the ampule being autoclaved.

3. An ampule according to claim 1 wherein the tubular body is glass and the end members are seal crimped thereon.

4. An ampule containing an air-free heat-expandable dosage solution and from which a plurality of dosages are to be withdrawn without contaminating the solution with air, said ampule comprising, in combination, a hollow tubular member having rubber seals at each end and defining an hermetic chamber, a moveable plunger disposed in said tubular member and dividing two compartments, one of said compartments sealing said dosage solution within an hermetic space and the second of said compartments defining an enclosed expansion space, said plunger being moveable into the enclosed expansion space upon autoclaving the ampule, said dosage solution being withdrawable from the ampule by breaking the rubber seal adjacent the enclosed expansion space whereby the plunger is moveable under the force of external air pressure upon discharge of said dosage solution via a syringe needle inserted into the rubber seal toward the hermetic space for maintaining the air-free integrity of the solution in the hermetic space.

* * * * *